US008147221B2

(12) United States Patent
Fu et al.

(10) Patent No.: US 8,147,221 B2
(45) Date of Patent: Apr. 3, 2012

(54) ELECTROMAGNETIC MICRO-PUMP

(75) Inventors: Lung-Ming Fu, Pingtung County (TW); Chia-Yen Lee, Pingtung County (TW); Chih-Yung Wen, Pingtung County (TW)

(73) Assignee: National Pingtung University of Science and Technology, Pingtung County (TW)

( * ) Notice: Subject to any disclaimer, the term of this patent is extended or adjusted under 35 U.S.C. 154(b) by 689 days.

(21) Appl. No.: 12/337,716

(22) Filed: Dec. 18, 2008

(65) Prior Publication Data

US 2010/0111726 A1 May 6, 2010

(30) Foreign Application Priority Data

Oct. 31, 2008 (TW) ..... 97142192 A

(51) Int. Cl.
*F04B 17/00* (2006.01)

(52) U.S. Cl. ..... 417/413.1; 417/413.3

(58) Field of Classification Search ..... 417/413.1, 417/413.3

See application file for complete search history.

(56) References Cited

U.S. PATENT DOCUMENTS 5,171,132 A * 12/1992 Miyazaki et al. ..... 417/413.1
6,203,291 B1 3/2001 Stemme et al.
7,011,507 B2 * 3/2006 Seto et al. ..... 417/412
7,059,836 B2 * 6/2006 Takagi et al. ..... 417/44.2
2005/0019180 A1 * 1/2005 Seto et al. ..... 417/413.1
2006/0045766 A1 * 3/2006 Harttig et al. ..... 417/412
2006/0083639 A1 * 4/2006 Liu et al. ..... 417/413.2
2007/0128055 A1 * 6/2007 Lee ..... 417/413.1

FOREIGN PATENT DOCUMENTS

TW I256374 4/2006

* cited by examiner

*Primary Examiner* — Toan Ton
*Assistant Examiner* — Kevin Quarterman
(74) *Attorney, Agent, or Firm* — Alan Kamrath; Kamrath IP Lawfirm, PA

(57) ABSTRACT

An electromagnetic micro-pump includes a substrate, a top plate, a magnetic diaphragm, and a coil unit. The substrate includes a first face and a second face. The first face includes a groove. The top plate is mounted on the first face of the substrate. The top plate includes an input hole, an output hole, and a through-hole. Each of the input hole, the output hole, and the through-hole extends through the top plate and is in communication with the groove. The through-hole is between the input hole and the output hole. The magnetic diaphragm is elastically deformable and mounted to an outer face of the top plate to seal the through-hole. The coil unit is mounted to the second face of the substrate and aligned with the through-hole.

7 Claims, 7 Drawing Sheets

ELECTROMAGNETIC MICRO-PUMP

BACKGROUND OF THE INVENTION

1. Field of the Invention

The present invention relates to a micro-pump and, more particularly, to an electromagnetic micro-pump.

2. Description of the Related Art

Taiwan Patent No. I256374 (with a patent publication number of 200611872) entitled "PDMS VALVELESS MICRO-PUMP STRUCTURE AND PROCESS FOR MAKING THE SAME" discloses a PDMS (polydimethylsiloxane) structure, a diaphragm, and a piezoelectric actuator. The PDMS structure includes an upper face having a cavity. The upper face further includes an input groove and an output groove that are in communication with the cavity. The input and output grooves extend to a lower face of the PDMS structure to form an input opening and an output opening. The diaphragm is mounted on the upper face of the PDMS structure to seal the input groove and output groove and includes a central opening aligned with the cavity. The piezoelectric actuator is sealingly fixed in the central opening of the diaphragm.

In use, the input opening is connected to a fluid source, and the piezoelectric actuator is actuated by electricity. When the piezoelectric actuator deflects in a direction away from the cavity, a pressure difference is created to cause flow of the fluid from the fluid source toward the input groove. When the piezoelectric actuator deflects toward the cavity, the piezoelectric actuator creates pressure on the fluid in the cavity, moving the fluid toward the output groove. By repeatedly vibrating the cavity through operation of the piezoelectric actuator, the fluid flows from the input opening into the input groove and then exits the output groove via the output opening.

However, the vibrational displacement of the piezoelectric actuator is small, such that the micro-pump can only be driven by high frequency vibration and, thus, consumes a larger amount of energy. Furthermore, the piezoelectric actuator is made of expensive piezoelectric material, leading to an increase in the costs of the micro-pump.

SUMMARY OF THE INVENTION

The primary objective of the present invention is to provide an electromagnetic micro-pump including a diaphragm having a longer vibrational displacement.

An electromagnetic micro-pump according to the preferred teachings of the present invention includes a substrate, a top plate, a magnetic diaphragm, and a coil unit. The substrate includes a first face and a second face. The first face includes a groove. The top plate is mounted on the first face of the substrate. The top plate includes an input hole, an output hole, and a through-hole. Each of the input hole, the output hole, and the through-hole extends through the top plate and is in communication with the groove. The through-hole is between the input hole and the output hole. The magnetic diaphragm is elastically deformable and mounted to an outer face of the top plate to seal the through-hole. The coil unit is mounted to the second face of the substrate and aligned with the through-hole.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
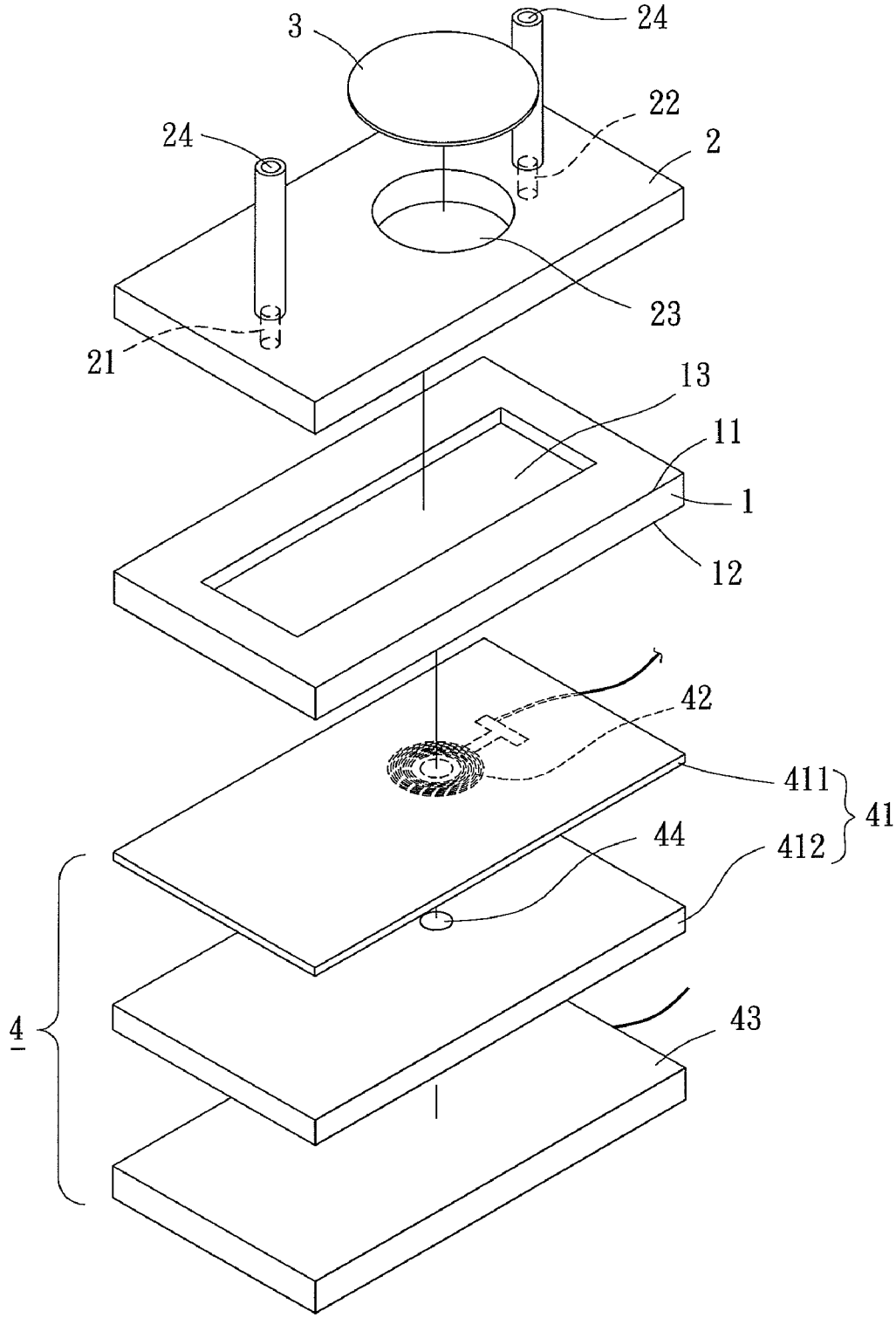
FIG. 1 shows an exploded, perspective view of an electromagnetic pump according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "portion", "spacing", "clockwise", "counterclockwise", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An electromagnetic micro-pump according to the preferred teachings of the present invention is shown in the drawings and includes a substrate 1, a top plate 2, a magnetic diaphragm 3, and a coil unit 4. The substrate 1 is mounted between the top plate 2 and the coil unit 4, and the magnetic diaphragm 3 is mounted on top of the top plate 2.

According to the preferred form shown, the substrate 1 is made of glass material and includes first and second faces 11 and 12 and a groove 13 defined in the first face 11 for receiving a fluid. In the most preferred form shown, the substrate 1 has a thickness of 1 mm, and the groove 13 has a thickness of 30 μm.

According to the preferred form shown, the top plate 2 is made of glass material and mounted on the first face 11 of the substrate 1. The top plate 2 includes an input hole 21, an output hole 22, and a through-hole 23. Each of the input hole 21, the output hole, 22, and the through-hole 23 extends through the top plate 2 and is in communication with the groove 13. The input hole 21 allows the fluid to flow into the groove 13, and the output hole 22 allows the fluid to flow out of the groove 13. In the most preferred form shown, two tubes 24 are respectively mounted to the input hole 21 and the output hole 22. One of the tubes 24 mounted to the input hole 21 is in communication with a fluid source, and the other one of the tubes 24 mounted to the output hole 22 is for guiding the fluid to a desired location. The through-hole 23 has a cross-sectional area larger than those of the input hole 21 and the output hole 22. The electromagnetic micro-pump operates according to the principle of an impedance pump. Specifically, a spacing between the through-hole 23 and the input hole 21 is not equal to that between the through-hole 23 and the output hole 22. Namely, the through-hole 23 in the first face 11 is in an impedance-mismatched position between the input hole 21 and the output hole 22. When the magnetic diaphragm 3 vibrates, uneven pressure distribution occurs in the fluid to move the fluid in the same direction, acting as a valveless pump. In the most preferred form shown, the spacing between the input hole 21 and the through-hole 23 is larger than that between the output hole 22 and the through-hole 23, such that the through-hole 23 is not in the middle between the input hole 21 and the output hole 22. Furthermore, the top plate 2 has a thickness of 1 mm.

Figure 2A:
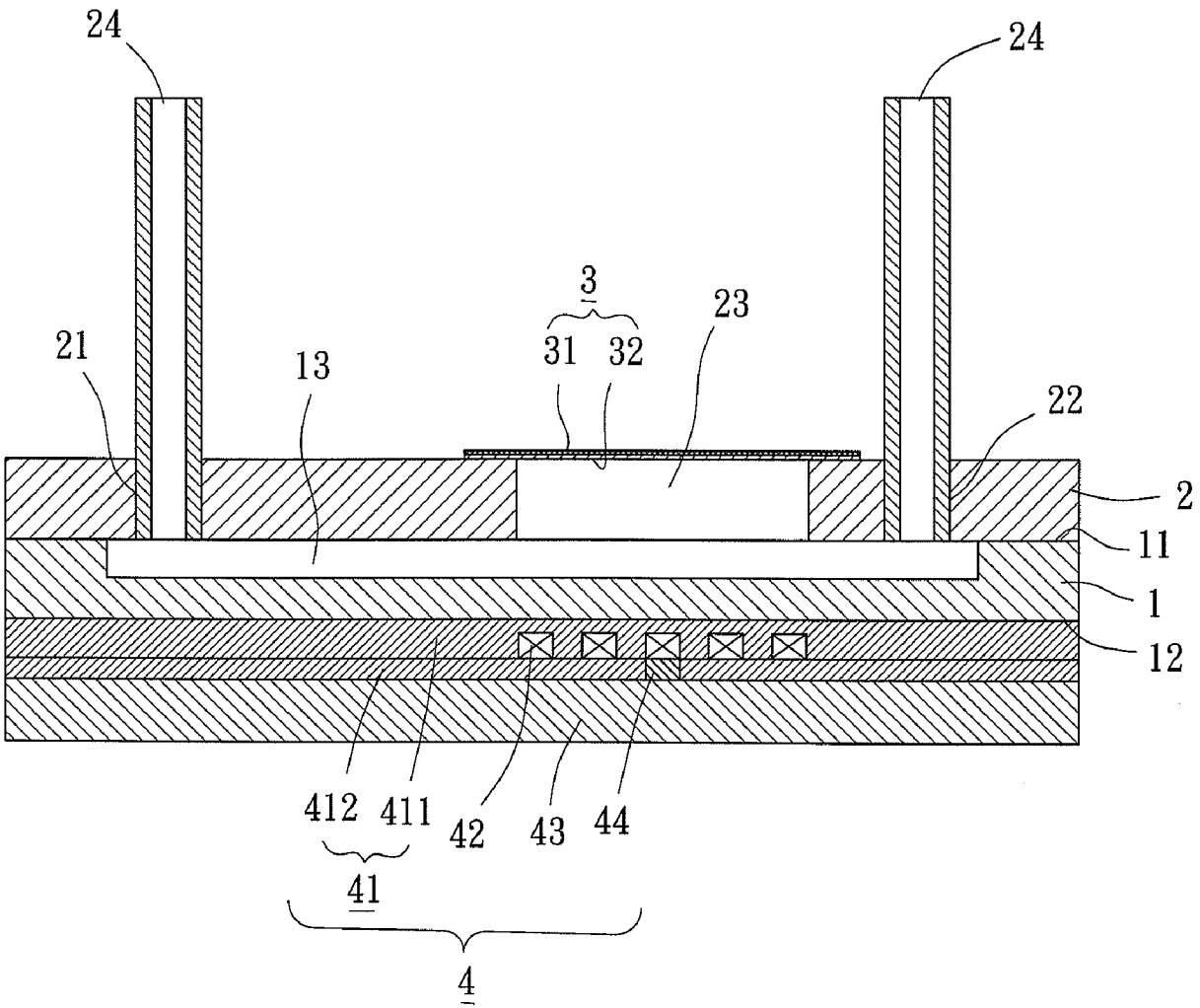
FIG. 2 shows a cross sectional view of the electromagnetic pump of FIG. 1.
Figure 2B:
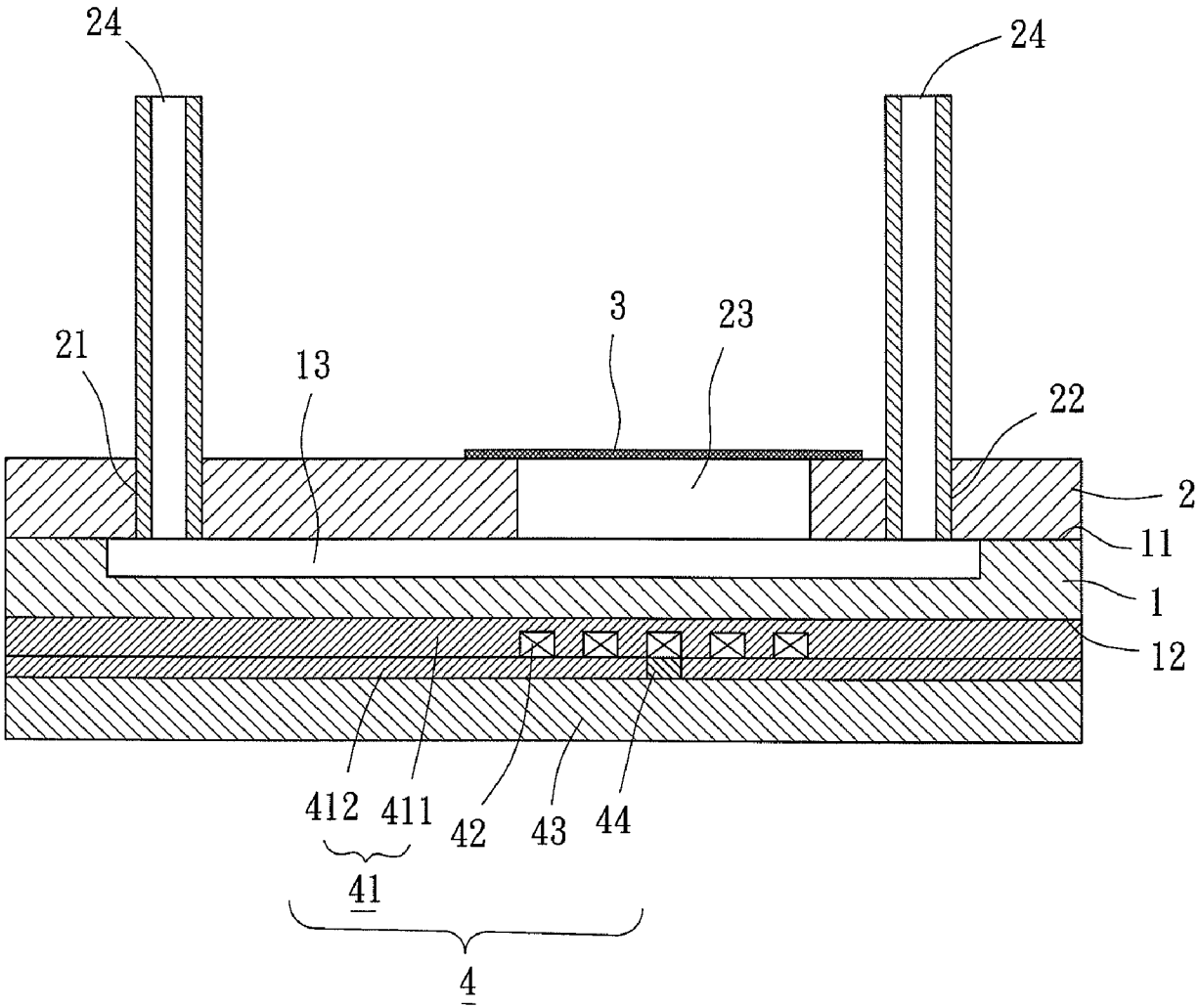

According to the preferred form shown, the magnetic diaphragm 3 is mounted on an outer face of the top plate 2 to seal the through-hole 23. The magnetic diaphragm 3 is elastically deformable and can be formed by coating a layer of magnetic material on a face of an elastically deformable film such as a PDMS (polydimethylsiloxane) membrane, so that the magnetic diaphragm 3 includes a magnetic layer 31 and an elastic film 32 facing the through-hole 23 as shown in FIG. 2*a*. Alternatively, the magnetic diaphragm 3 can be made of a combination of magnetic material and plastic material as shown in FIG. 2*b*. By providing the magnetic diaphragm 3, the displacement obtained is larger than that of piezoelectric material. In the most preferred form shown, the magnetic diaphragm 3 has a magnetic field intensity of 1.4 Tesla and a thickness of 100 μm.

According to the preferred form shown, the coil unit 4 is mounted to the second face 12 of the substrate 1 and aligned with the through-hole 23. The coil unit 4 includes an insulating layer 41, a coil 42, an electrode layer 43, and a connecting portion 44. The insulating layer 41 is made of insulating material. In the most preferred form shown, the insulating layer 41 is made of polyimide and includes a first insulating layer 411 mounted to the second face 12 of the substrate 1 and a second insulating layer 412 mounted to a bottom face of the first insulating layer 411, such that the first insulating layer 411 is between the substrate 1 and the second insulating layer 412. The coil 42 is embedded in the first insulating layer 411 and exposed on the bottom face of the first insulating layer 411 to which the second insulating layer 412 is mounted. In the most preferred form shown, the coil 42 is aligned with the through-hole 23 and has a width in a range between 75-125 μm. The electrode layer 43 is mounted to a bottom face of the second insulating layer 412, such that the second insulating layer 412 is between the first insulating layer 411 and the electrode layer 43. The connecting portion 44 is mounted in and extends through the second insulating layer 412, such that the coil 42 is electrically connected to the electrode layer 43 via the connecting portion 44. The coil unit 4 can be manufactured by developing etching or electroplating.

Figure 3:
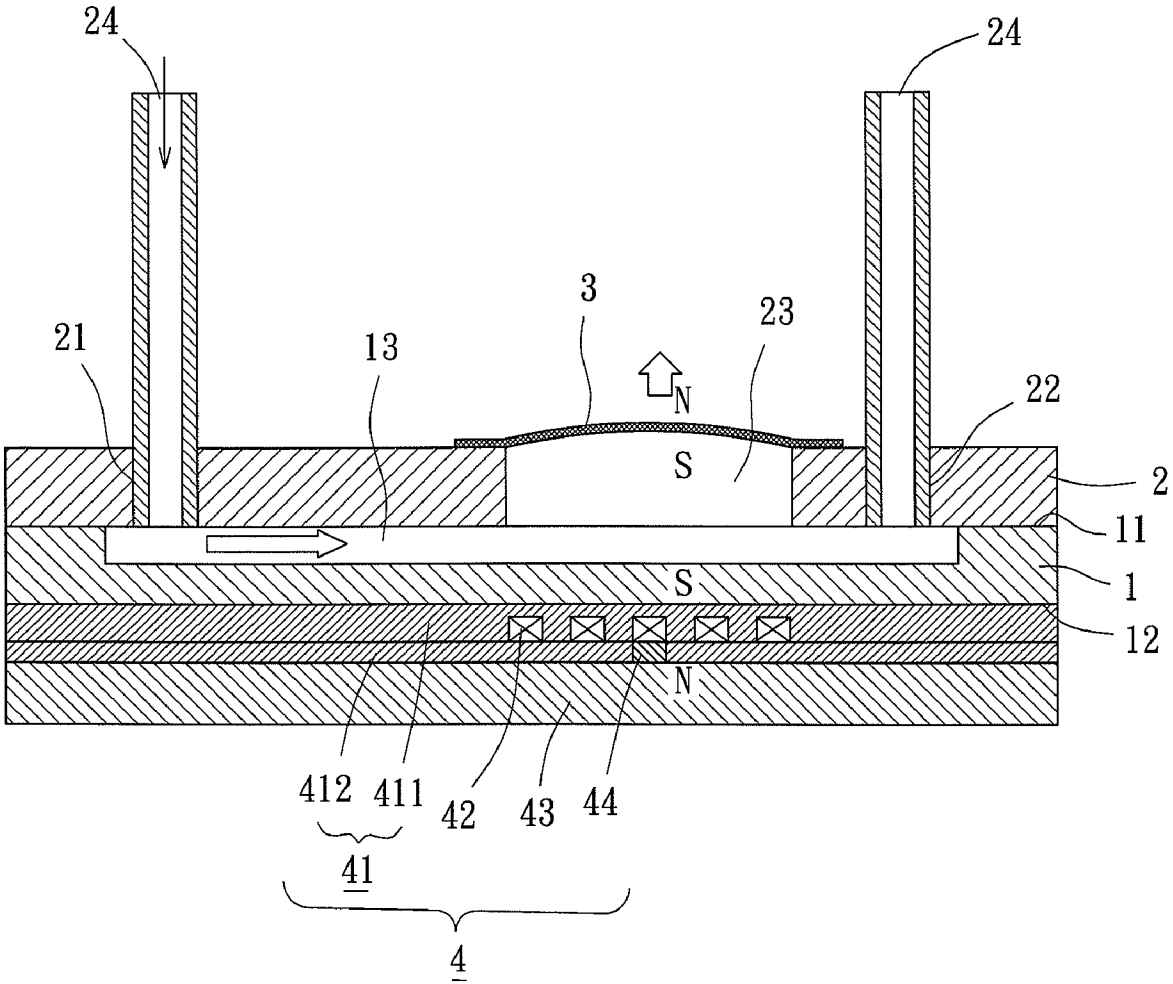
FIG. 3 shows a cross sectional view illustrating operation of the electromagnetic pump of FIG. 1 with a magnetic diaphragm deflected in a direction.
Figure 4:
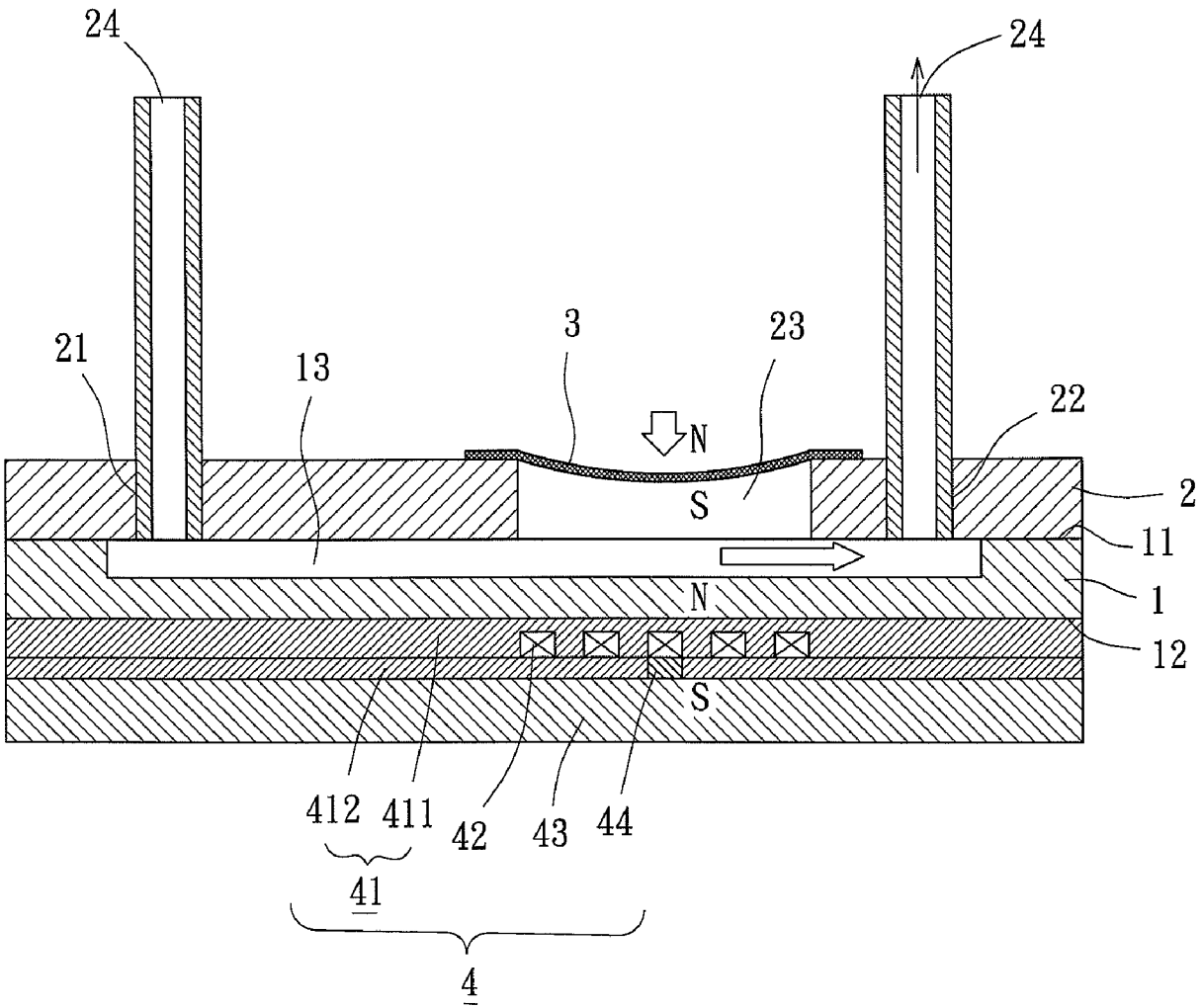
FIG. 4 shows a cross sectional view illustrating operation of the electromagnetic pump of FIG. 1 with a magnetic diaphragm deflected in a reverse direction.

In use, the electrode layer 43 is electrically connected to a power source, so that current is input in a direction to the coil 42. In the preferred form shown, the north pole N of the magnetic field created by the magnetic diaphragm 3 is above the magnetic diaphragm 3, and the south pole S of the magnetic field created by the magnetic diaphragm 3 is below the magnetic diaphragm 3. The current is input in the clockwise direction (viewed from top). The coil 42 creates a magnetic field having a south pole S above the coil 42 and a north pole N below the coil 42. Thus, the magnetic field created by the coil 42 is repulsive to the magnetic field created by the magnetic diaphragm 3. As a result, the magnetic diaphragm 3 deflects in a direction away from the through-hole 23, so that a space defined by the magnetic diaphragm 3 and an inner peripheral wall delimiting the through-hole 23 is increased. Thus, a pressure difference is created between the space and the fluid source outside of the electromagnetic micro-pump (FIG. 3). Accordingly, instead of flowing into the space via the output hole 22, the fluid received in the space previously flowed into the space from the fluid source through the input hole 21 and the groove 13.

On the other hand, when the input direction of the current is changed to the counterclockwise direction (viewed from top), the coil 42 creates a magnetic field having a south pole S below the coil 42 and a north pole N above the coil 42. Thus, the magnetic field created by the coil 42 is attractive to the magnetic field created by the magnetic diaphragm 3. As a result, the magnetic diaphragm 3 deflects toward the through-hole 23, so that the fluid in the through-hole 23 is pressed. Since the through-hole 23 is in the impedance-mismatched position, the fluid flows out of the output hole 22 rather than the input hole 21. By repeatedly changing the input direction of the current to repeatedly repulse and attract the magnetic diaphragm 3, fluid is sucked into the groove 13 via the input hole 21 and flows out of the groove 13 via the output hole 22.

Since the electromagnetic micro-pump according to the preferred teachings of the present invention utilizes the electromagnetically attractive force and electromagnetically repulsive force between the coil 42 and the magnetic diaphragm 3 as the driving force, the magnetic diaphragm 3 has a larger vibrational amplitude. Thus, the electromagnetic micro-pump according to the preferred teachings of the present invention can be operated without the need of high frequency vibration of the magnetic diaphragm 3. The energy consumed is reduced, and the overall costs for manufacturing the electromagnetic micro-pump according to the preferred teachings of the present invention can be cut.

Figure 5:
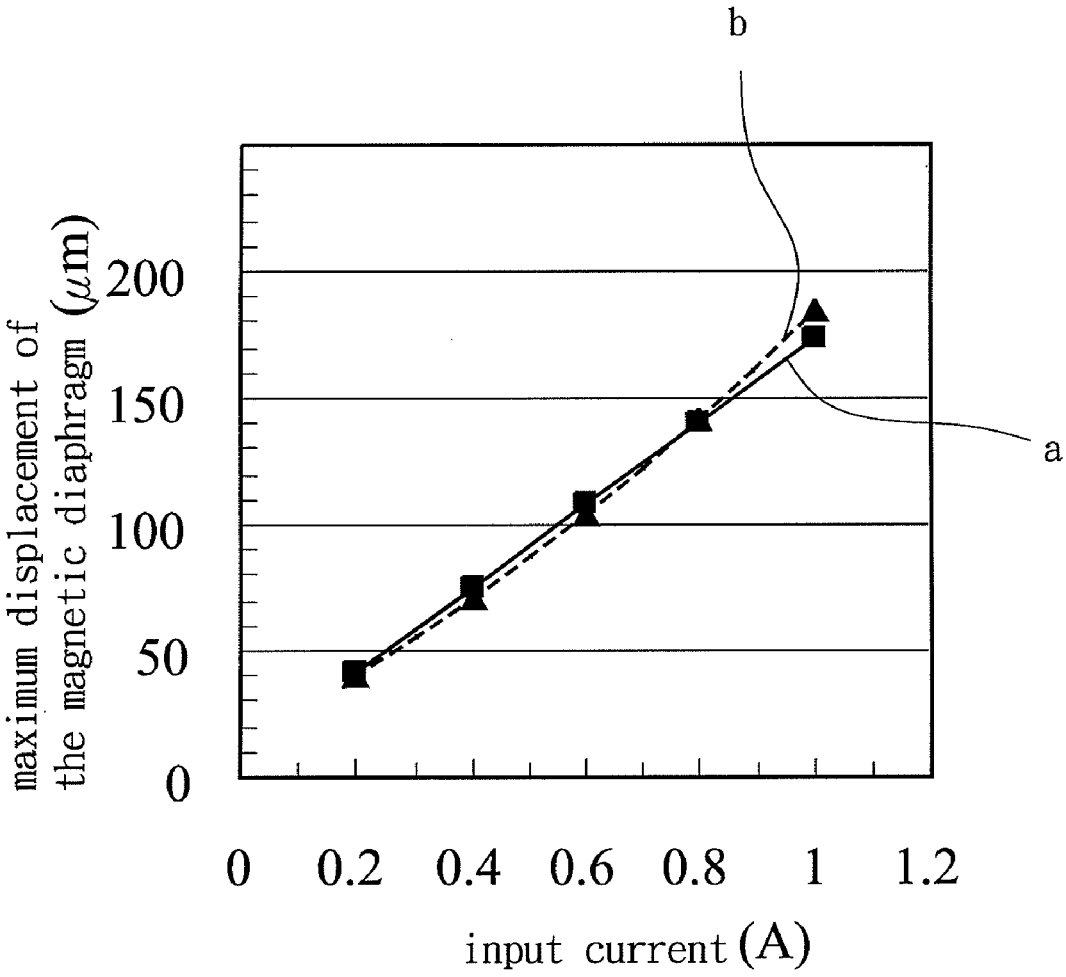
FIG. 5 shows a diagram illustrating relationship between the maximum displacement of the magnetic diaphragm and the input current.
Figure 6:
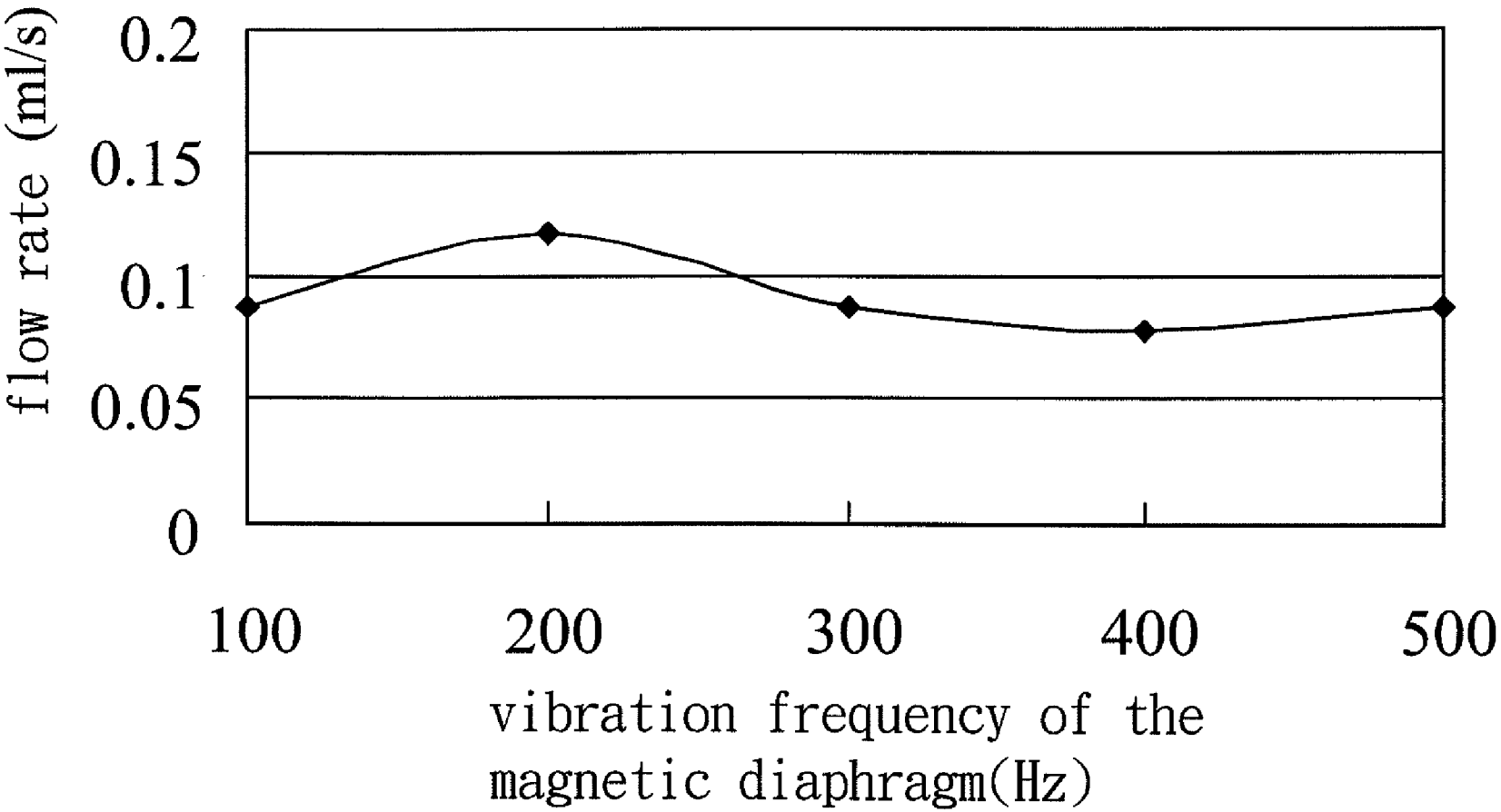
FIG. 6 shows a diagram illustrating a relationship between the flow rate of the electromagnetic micro-pump and the vibration frequency of the magnetic diaphragm.

Tests have been conducted to verify operation of the electromagnetic micro-pump according to the preferred teachings of the present invention. FIG. 5 shows the relationship between the maximum displacement of the magnetic diaphragm 3 and the input current. Line "a" represents the theoretical displacements of the magnetic diaphragm 3, and line "b" represents the actual displacements of the magnetic diaphragm 3. In accordance with the results shown in FIG. 5, the maximum displacement of 180 μm of the magnetic diaphragm 3 proves that a great amount of displacement of the magnetic diaphragm 3 is achievable. FIG. 6 shows the relationship between the flow rate of the electromagnetic micro-pump according to the preferred teachings of the present invention and the vibration frequency of the magnetic diaphragm 3. According to the test results, vibration of the magnetic diaphragm 3 at a frequency of hundreds of hertz is sufficient to drive the electromagnetic micro-pump according to the preferred teachings of the present invention, while conventional electromagnetic micro-pumps require vibration at a frequency of tens of thousands of hertz, which is hundreds of times of that of the present invention. Thus, the energy consumed by the electromagnetic micro-pump according to the preferred teachings of the present invention is significantly reduced, for the starting frequency of the electromagnetic micro-pump according to the preferred teachings of the present invention is significantly lower than that of conventional micro-pumps.

As mentioned above, the electromagnetic micro-pump according to the preferred teachings of the present invention utilizes the electromagnetically attractive force and electromagnetically repulsive force between the coil 42 and the magnetic diaphragm 3 to vibrate the magnetic diaphragm 3, so that the magnetic diaphragm 3 has a larger displacement.

Furthermore, the electromagnetic micro-pump according to the preferred teachings of the present invention can be operated at a low starting frequency and thus, consumes less energy. Furthermore, the magnetic diaphragm 3 can be manufactured at low costs, so that the overall costs for manufacturing the electromagnetic micro-pump according to the preferred teachings of the present invention can be cut.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An electromagnetic micro-pump comprising:

a substrate including a first face and a second face, with the first face including a groove;

a top plate mounted on the first face of the substrate, with the top plate including an input hole, an output hole, and a through-hole, with each of the input hole, the output hole, and the through-hole extending through the top plate and in communication with the groove, with the through-hole being between the input hole and the output hole;

an elastically deformable magnetic diaphragm mounted to an outer face of the top plate to seal the through-hole; and a coil unit mounted to the second face of the substrate and aligned with the through-hole, with the coil unit including an insulating layer, a coil, an electrode layer, and a connecting portion, with the insulating layer mounted to the second face of the substrate, with the coil embedded in the insulating layer, with the electrode layer mounted to a bottom face of the insulating layer, such that the insulating layer is between the substrate and the electrode layer, and with the connecting portion mounted in the insulating layer, such that the coil is electrically connected to the electrode layer via the connecting portion.

2. The electromagnetic micro-pump as claimed in claim 1, with a spacing between the through-hole and the input hole being not equal to that between the through-hole and the output hole.

3. The electromagnetic micro-pump as claimed in claim 1, with the through-hole having a cross-sectional area larger than those of the input hole and the output hole.

4. The electromagnetic micro-pump as claimed in claim 1, with the magnetic diaphragm including an elastic film and a magnetic layer, and with the elastic film facing the through-hole.

5. The electromagnetic micro-pump as claimed in claim 4, with the elastic film of the magnetic diaphragm being made of polydimethylsiloxane.

6. The electromagnetic micro-pump as claimed in claim 1, with the magnetic diaphragm being made of a combination of magnetic material and plastic material.

7. The electromagnetic micro-pump as claimed in claim 1, with the insulating layer including a first insulating layer and a second insulating layer, with the first insulating layer mounted to the second face of the substrate and between the substrate and the second insulating layer, with the coil mounted in the first insulating layer and exposed to the bottom face of the first insulating layer, and with the connecting portion extending through the second insulating layer.

* * * * *